United States Patent [19]

Rachel

[11] Patent Number: 4,892,446

[45] Date of Patent: Jan. 9, 1990

[54] GROUP CONTROL MEANS FOR HYDRAULIC MINE-ROOF SUPPORTS

[75] Inventor: Andreas Rachel, Wuppertal, Fed. Rep. of Germany

[73] Assignee: Herman Hemscheidt Maschinenfabrik GmbH & Co., Wuppertal, Fed. Rep. of Germany

[21] Appl. No.: 299,003

[22] Filed: Jan. 19, 1989

[30] Foreign Application Priority Data

Jan. 21, 1988 [DE] Fed. Rep. of Germany ..... 3801593

[51] Int. Cl.[4] ..... E21D 15/44

[52] U.S. Cl. ..... 405/302; 405/291; 299/11

[58] Field of Search ..... 405/302, 291, 301; 299/11, 1, 33, 31; 91/170 MP, 530, 527, 529, 522; 137/596.16, 596.17

[56] References Cited

U.S. PATENT DOCUMENTS

| | | | |
|---|---|---|---|
| 3,507,122 | 4/1970 | Schmidt | 405/302 |
| 4,050,256 | 9/1977 | Phillips et al. | 299/11 |
| 4,134,270 | 1/1979 | Small et al. | 405/302 |
| 4,378,027 | 3/1983 | Weirich et al. | 137/596.16 |
| 4,379,662 | 4/1983 | Block | 91/170 MP |
| 4,679,856 | 7/1987 | Lubojatsky et al. | 405/302 X |
| 4,708,394 | 11/1987 | Trox et al. | 405/302 X |

FOREIGN PATENT DOCUMENTS

| | | | |
|---|---|---|---|
| 2212686 | 9/1973 | Fed. Rep. of Germany | 405/302 |
| 2095736 | 10/1982 | United Kingdom | 405/302 |

*Primary Examiner*—Dennis L. Taylor

*Attorney, Agent, or Firm*—Aisenberg & Platt Berman

[57] ABSTRACT

An electro-hydraulic control system for self-advancing mine-roof supports in a high-output longwall mine is used to form a sequence zone behind the mining machine whereby individual supports simultaneously operate in the sequence of prop drawing, advancing and setting so that, during the sequence, the roof in the sequence zone is supported by at least each second support with the length of the sequence phase so depending on the cutting speed of the mining machine that it increases with increasing speed to ensure that the roof exposed by the mining machine is supported without delay.

4 Claims, 2 Drawing Sheets

GROUP CONTROL MEANS FOR HYDRAULIC MINE-ROOF SUPPORTS

Figure 1:
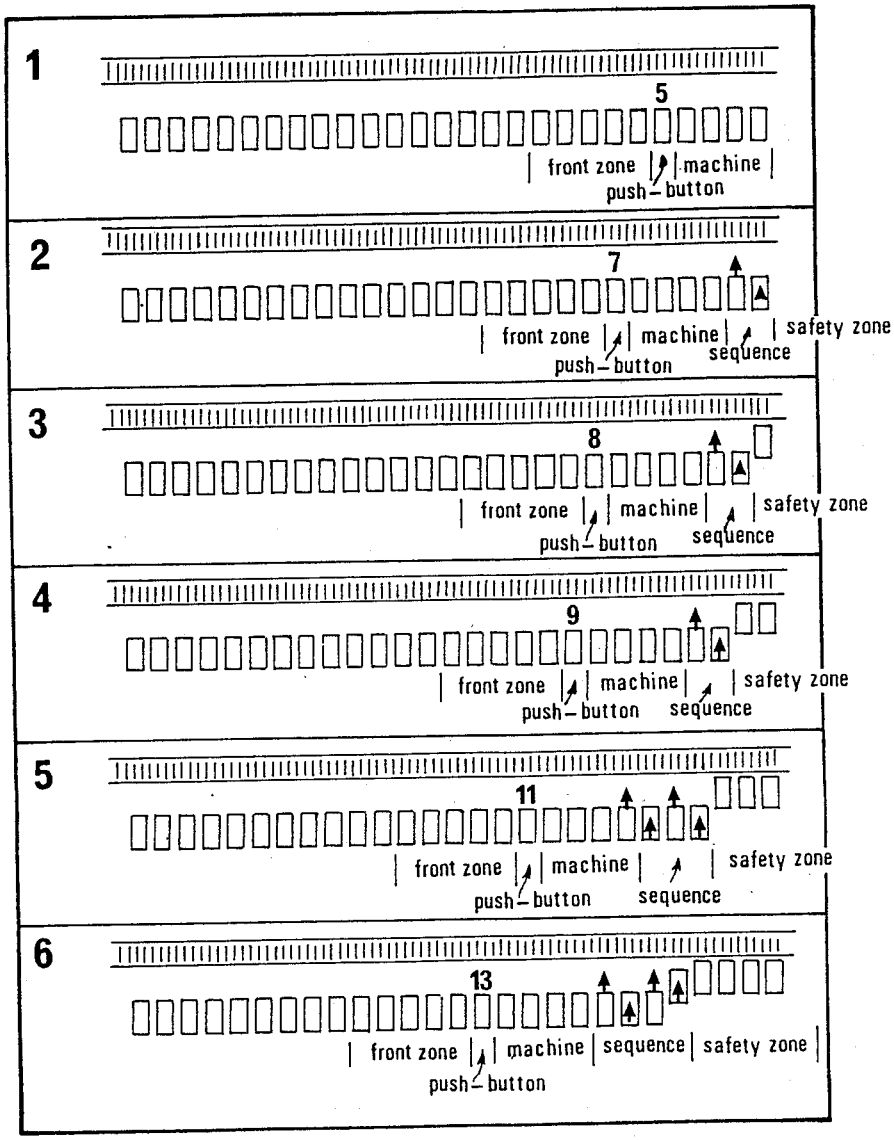
Figure 2:
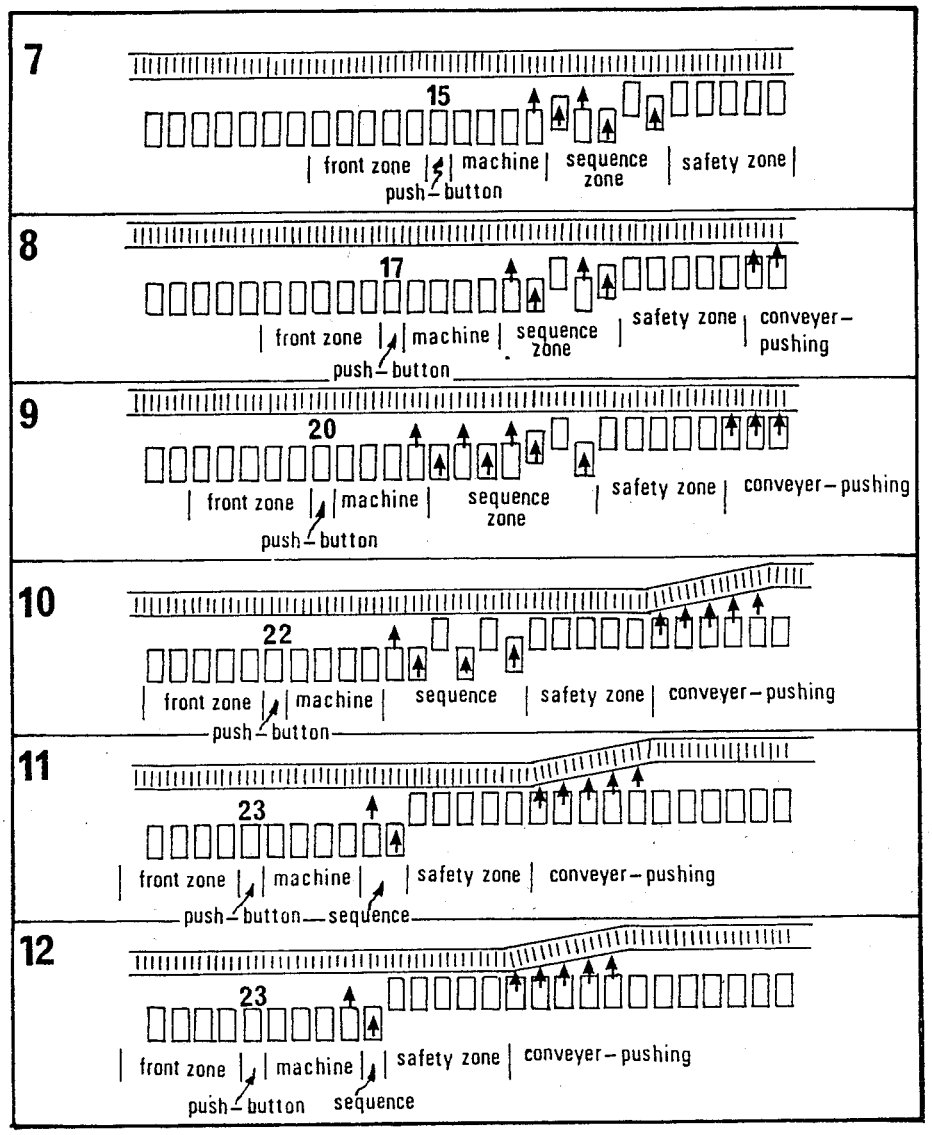

The invention relates to a group control means for a hydraulic self-advancing support according to the preamble of claim 1.

In a high-output longwall, the hydraulic self-advancing support is controlled by programmed-controlled microprocessors which store the test data regarding the operating sequence and evaluate the programme accordingly. The individual face-support operations, more particularly the sequence of prop drawing, advancing and setting, are triggered externally, e.g. by actuating a push-button, whereupon the sequence occurs automatically.

A group includes all those support units which carry out the support operation around the mining machine. Within the group, those support units carrying out the same function belong to a zone. The group or the zones move with the mining machine in the longwall.

In order to support the roof in optimum manner during cutting, the face support must advance without delay immediately after the mining machine has passed through. This is necessary when the face support in the "one step back" system remains one step behind the conveyor at the beginning of a mining or working cut. In that case the self-advancing rams of the support units attached to the conveyor will be non-pressurised, both in the zone in front of the mining machine and in the subsequent machine zone. Behind the mining machine, the support units advance in succession. There follows a "safety zone" in which the self-advancing rams of the support units, as before, are not set at conveyor pushing, in order not to interfere with the mining work. Finally there is the conveyor-pushing zone, in which the self-advancing rams of the preceding support units are extended and press the conveyor against the working face along the exposed area.

The advance of the support is triggered by a push-button in dependence on the position of the mining machine, either by a person accompanying the machine or from a control station outside the longwall. In known support control means, the automatic sequence of prop drawing, advancing and setting occur successively in each support unit, but in only one unit at a time.

The cutting speeds of modern mining machines are already so high that the roof support has difficulty in following and therefore remains behind the machine. The tempo of the advance process is limited by various hydraulic factors, more particularly the rated sizes of the valves. In a support unit 1.5 meters wide, a sequence lasting 10 seconds is insufficient to follow a machine cutting at a speed of 10 m/min. Higher cutting speeds will inevitably lead to an increase in the exposed, non-timbered roof surface. The mining machine has to be stopped to avoid the disadvantages resulting from delaying the roof support, which would affect the entire longwall region.

The object of the invention therefore is to adapt an electro-hydraulic group control means for self-advancing supports in mining, so that the support can follow the cutting speed of the mining machine without delay and without adversely affecting the necessary safety of the roof.

This problem is solved by the means disclosed in the characterising part of claim 1. Advantageous embodiments of the invention are disclosed in the subclaims.

According to the invention, the advance sequence occurs in a sequence zone adjacent the machine zone, where individual support units can also advance simultaneously if required by the cutting speed of the machine in front. The length of the sequence zone depends on the position of the mining machine, which is input by the push-button. It extends as far as the rearward safety zone, in which the support units have advanced and been set, but the self-advancing rams have not yet been positioned for conveyor-pushing.

Initially, the support units advance individually in succession as long as the sequence keeps pace with the mining. A sequence zone comprising a number of support units is formed only when the distance between the mining machine and the set-back face support becomes increasingly large and the face support threatens to lag behind the machine. When a number of support units are operating simultaneously, the area exposed during mining is timbered without delay. The simultaneous operating sequence ensures that the roof in the sequence zone is supported and secured by at least each second support unit.

When actuated, the push-button triggers the sequence in each second support unit inside the sequence zone, provided both neighbouring support units have been set. At the same time, the self-advancing rams in the neighbouring units in the mining direction are set at conveyor-pushing, in order to produce the abutment on the working-face side. In these set-back support units, the sequence is automatically triggered as soon as the exposed roof has been secured on both sides by the neighbouring units in front.

The invention will now be explained in detail with reference to an embodiment shown in the drawing. The drawing is a flow chart of twelve successive operating stages in a high-output longwall.

1. The conveyor and the face-support units disposed parallel thereto on the gob side are represented by symbols. At the beginning of mining work, the support is one step behind the conveyor. The mining machine extends over the length of four support units, which constitute the machine zone. In a front zone comprising five support units, the pushing rams of the support units are non-pressurised. Any forepoling roof timbers are retracted. The accompanying person or assistant is in front of the machine zone in the fifth support unit from the right, and triggers the support sequence behind the mining machine by actuating a push-button.
2. The mining machine has advanced by two support units. The assistant, at the seventh support unit, actuates the push-button for the sequence behind the machine zone, where a sequence zone is formed comprising two support units. The automatic sequence of prop drawing, advancing and setting begins in the last support unit in the direction of mining. The pushing ram of the neighbouring support unit on the left is set at conveyor-pushing.
3. The mining machine operates at a cutting speed adapted to the rate of advance. After the first sequence, the sequence for the next support unit is triggered from the eighth support unit, and the conveyor is held by the pushing ram of the adjacent unit on the left. The support unit which has already advanced enters the adjacently-formed safety zone, where all the pushing rams are non-pressurised.
4. The previously-described sequence is repeated from the ninth support unit.

5. The cutting speed of the mining machine increases, and the assistant triggers the sequence by the push-button on the eleventh support unit. The sequence zone now comprises three support units, out of which the first and the third unit are beginning the sequence.
6. The sequence zone widens. The support units behind, which have held the conveyor, now carry out the sequence.
7. Five units are now included in the sequence zone, by pressing the button in the fifteenth support unit. Three units are simultaneously set at the operating sequence. The safety zone has extended to its final length of five support units.
8. The mining machine has cut and exposed two additional areas. The length of the sequence zone remains unchanged, and two support units have moved from the safety zone into the next-following or conveyor-pushing zone.
9. The cutting speed is increased, so that a total of seven support units are included in the sequence zone by the push-button 20. Four units are operating the sequence simultaneously. As the diagram shows, the roof in the sequence zone is supported in each phase by at least each second support unit.
10. The cutting speed is reduced, so that the sequence zone is shortened to seven support units. The support units which have already advanced now form the abutment for the conveyor during the sequence.
11. After the cutting speed has been further reduced, the area of only one support unit is exposed by cutting. The sequence zone now comprises only two support units.
12. The mining machine stops and the last support unit behind the machine zone stops the sequence. The safety zone is immediately adjacent thereto.

I claim:

1. A group control means for a hydraulic self-advancing support in a high-output longwall comprising face support units which are electro-hydraulically controlled in groups in accordance with the position of the mining machine and which operate automatically in the sequence of prop drawing, advancing and setting, characterised in that a sequence zone, the extent of which is adapted to be influenced by the cutting speed of the mining machine, is formed behind the mining machine, and individual support units therein carry out the sequence simultaneously and continuously and in dependence on one another, the roof being supported by at least each second support unit.

2. A group control means according to claim 1, characterised in that the respective position and extent of the sequence zone is determined in dependence on the position of the mining machine by actuating a push-button, and a safety zone is formed adjacent the last support unit in the sequence zone and advancing in the direction of mining.

3. A group control means according to claim 1, characterised in that the sequence in the sequence zone is initiated by the push-button in the last support unit in the mining direction, provided that both adjacent support units are set, and in the penultimate support unit the self-advancing ram is set at conveyor-pushing and the sequence is blocked.

4. A group control means according to claim 1, characterised in that the sequence in the respective set-back locked support unit is triggered immediately after setting the two neighbouring support units.

* * * * *